United States Patent [19]

Klein-Albenhausen

[11] 4,389,142

[45] Jun. 21, 1983

[54] SILO SYSTEM FOR FLOURY LOOSE MATERIALS, PARTICULARLY CEMENT

[75] Inventor: Heinrich Klein-Albenhausen, Hamburg, Fed. Rep. of Germany

[73] Assignee: Ibau Hamburg Ingenieurgesellschaft Industriebau mbH, Hamburg, Fed. Rep. of Germany

[21] Appl. No.: 213,408

[22] Filed: Dec. 5, 1980

[30] Foreign Application Priority Data

Feb. 26, 1980 [DE] Fed. Rep. of Germany ..... 3007113

[51] Int. Cl.[3] ..... B65G 53/26

[52] U.S. Cl. ..... 406/120; 414/288; 222/478

[58] Field of Search ..... 406/90, 120, 119, 118; 414/288; 222/478, 481

[56] References Cited

U.S. PATENT DOCUMENTS 3,306,676 2/1967 Gurney ..... 406/120

FOREIGN PATENT DOCUMENTS 2352455 7/1978 Fed. Rep. of Germany ..... 406/90
2827991 1/1980 Fed. Rep. of Germany .
2844589 4/1980 Fed. Rep. of Germany .
2705084 9/1980 Fed. Rep. of Germany ..... 406/70
940235 10/1963 United Kingdom .

OTHER PUBLICATIONS

Bausteine der I-Bau-Technik, Aug. 1976.
Aufbereitungs-Technik, Heft 1, 1973.
Sonderdruck Aus Zement-Kalk-Gips, Klein-Albenhausen-Jan. 1979.

*Primary Examiner*—John J. Love
*Assistant Examiner*—Gene A. Church
*Attorney, Agent, or Firm*—Staas & Halsey

[57] ABSTRACT

A silo system for flowing loose materials, particularly cement with at least two storage silos each with a conical cover raised over their base and on whose lower edge are provided discharge openings connected to a central storage tank, the storage silos being interconnected by a transverse conveying arrangement.

5 Claims, 1 Drawing Figure

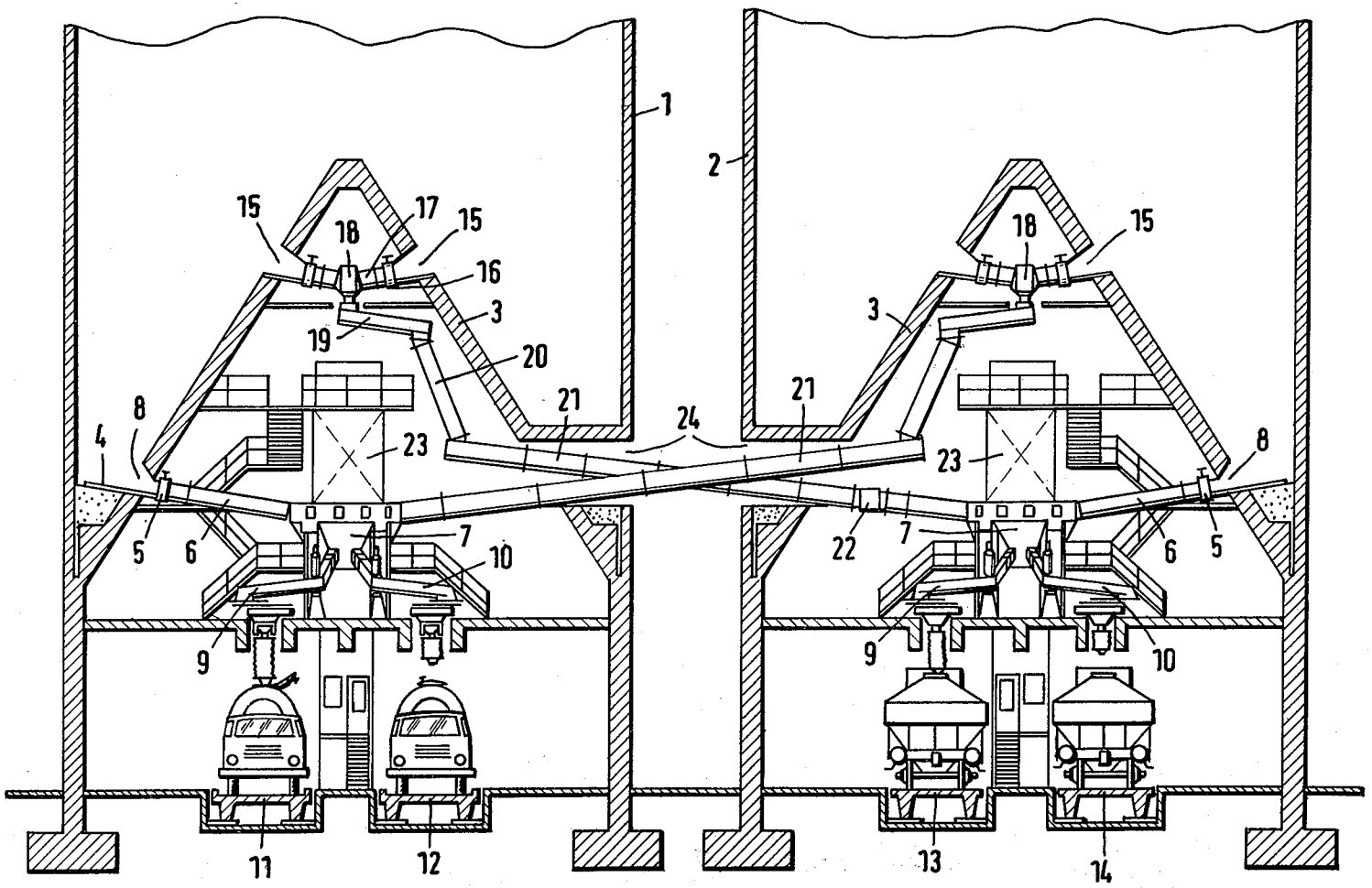
1
2
3
4
5
6
7
8
9
10
11
12
13
14
15
16
17
18
19
20
21
22
23
24

SILO SYSTEM FOR FLOURY LOOSE MATERIALS, PARTICULARLY CEMENT

BACKGROUND OF THE INVENTION

1. Field of the Invention

The present invention relates to a silo system for floury loose materials, particularly cement with at least two storage silos each with a conical cover raised over their base and on whose lower edge are provided discharge openings connected to a central storage tank, the storage silos being interconnected by a transverse conveying arrangement.

2. Description of the Prior Art

A silo system of the aforementioned type is known in which two storage silos are completely interconnected by a horizontally directed screw conveyor. The storage tanks to which material is supplied from the bottom of the silo under normal operating conditions are interconnected. This transverse conveying arrangement makes it possible to load material of a particular quality of one silo by means of the loading mechanism of the other silo. For example, one silo is equipped for packing into sacks or bags and the other for the loose discharge into trucks. The two storage silos contain materials of different qualities, so that it may be desirable to supply one packing or loading mechanism of one silo with material from the other silo, and vice versa. If such a screw conveyor is provided, it is always necessary for the material to firstly be conveyed through the discharge openings and the air conveyor channels associated therewith into the storage tanks and from there into the storage tanks of the other silo. In addition, screw conveyors are complicated and expensive, because very large diameters must be made available for conveying satisfactory quantities. This is not only costly, but in addition a relatively large amount of energy is required for operating such conveyors.

SUMMARY OF THE INVENTION

The object of the invention is to provide a silo system of the aforementioned type permitting an easier transverse conveying from one storage silo to the storage tank of the other storage silo.

According to the invention, this object is realized in that the transverse conveying arrangement is formed by slightly sloping air conveyor channels connecting further discharge openings provided in the upper area of each conical cover with the storage tank of the adjacent storage silo.

According to the invention, present the conical cover is again "cut" at a level which is above that of the discharge openings directly connected with the associated storage container of this silo. The resulting higher discharge openings can only be connected by means of air conveyor channels which are inclined to a greater or lesser extent with the storage tank of the other storage silo. In this way, it is possible to obviate the necessity for screw conveyors, because an adequate gradient is available, as is required for operating the air conveyor channels. As a result, operation is made simpler, less expensive, and in particular the necessary quantities of material can be conveyed without difficulty.

Advantageously, the silo system can be constructed in such a way that separately controllable shut-off valves are associated with the further discharge openings in the upper area of each conical cover. This makes it possible to supply in planned manner to the air conveyor channels, the amount of material available in the storage tank of the other storage silo.

It is also possible to construct the silo system in such a way that each air conveyor channel is subdivided by a steeply downwardly directed chute within the conical cover in which it is connected with the further discharge openings. This makes it possible to guide the air conveyor channel around other large components such as filters and the like arranged within the inner area of the conical cover, thereby positioning the passage through the cover and the silo wall at a low level in which the constructional costs are not as high.

DESCRIPTION OF THE DRAWING AND PREFERRED EMBODIMENT

The invention is described in greater detail hereinafter relative to a drawing illustrating a non-limitative embodiment.

The drawing shows two storage silos 1 and 2, whose upper area is cut off. To the extent that these silos have an identical construction, the same reference numerals are used for the same parts. Each silo has a raised base forming a conical cover 3. Air conveyor channels 4 in the vicinity of the base lead the material to discharge openings 8. Separately controllable shut-off valves 5 control the material transfer to the air conveyor channels 6 which convey the material into the storage tank 7. The nature of the construction of a storage silo is, for example, known from DAS No. 2,352,455.

By means of pivotable loading mechanisms 9 and 10, the material is removed from the storage tanks into road trucks 11 and 12 or the railway trucks 13, 14. A loading mechanism is, for example, described in DOS No. 2,705,084.

Instead of loading loose material, packing into sacks or bags is possible.

Each conical cover is also "cut" an additional time in its upper area to form further discharge openings 15 which, following separately controllable shut-off valves 16 are connected by means of short air conveyor channels 17 to a receptacle 18. The material supplied to receptacle 18 passes via a short air conveyor channel 19 into a chute 20 and from there into a conveyor channel 21 which bridges the considerable distance into the storage tank 7 of the other silo. To enable the two air conveyor channels 21 to pass one another, one of them is equipped with a joint 22, otherwise the components are the same.

The air conveyor channel of the silo from the receptacle 18 so a passage 24 in the conical cover wall is subdivided into two sections 19 and 21 by chute 20 in order to provide space for a filter 23. The passage 24 through the conical cover wall and the silo wall is as low as possible to keep said passage as short and small as possible.

Besides the shut-off valves 5 and 16, it is possible to provide crushing means which are indicated in the drawing.

It is obvious that more than two storage silos can be correspondingly interconnected. In all cases, it is ensured that the material from one silo can be supplied to the loading or packing means of the other silo in an economical and advantageous manner by air conveyor channels.

What is claimed is:

1. Apparatus for storing loose materials, such as cement, comprising:

at least two storage silos;

each silo having a base portion, a central storage tank, conveying means, and a conical cover portion over the base portion, wherein the conical cover portion of each silo has discharge openings in the lower area thereof connected to the central storage tank of the same silo by the conveying means and discharge openings in the upper area thereof for connection to the central storage tank of the other silo;

and transverse air conveying means interconnecting respectively the discharge opening in the upper area of each silo conical cover portion to the central storage tank of the other silo for transferring loose material between the silos.

2. Apparatus according to claim 1, wherein said transverse air conveying means includes conveyor channels sufficiently inclined from each of the respective upper area discharge openings to the corresponding central storage tanks for conveying loose material between silos without screw conveyors.

3. Apparatus according to claim 2, wherein separately controllable shut-off valves are provided for the discharge openings in the upper area of each conical cover portion.

4. Apparatus according to claim 2 or 3, wherein each conveyor channel further comprises a steeply downwardly directed chute within the respective conical cover portion in which the conveyor channel is connected to the respective upper area discharge opening.

5. Apparatus according to claim 1, wherein separately controllable shut-off valves are provided for the discharge openings in the upper area of each conical cover portion.

* * * * *